US005987694A

United States Patent [19]

Large

[11] Patent Number: 5,987,694

[45] **Date of Patent: *Nov. 23, 1999**

[54] TIRE PROTECTANT APPLICATOR

[75] Inventor: Charles F. Large, Carlsbad, Calif.

[73] Assignee: Egl 1 Inc, Carlsbad, Calif.

[ * ] Notice: This patent is subject to a terminal disclaimer.

[21] Appl. No.: 09/249,207

[22] Filed: Feb. 12, 1999

Related U.S. Application Data

[62] Division of application No. 08/963,526, Nov. 3, 1997, Pat. No. 5,896,616.

[51] Int. Cl.[6] ..... A47L 25/00; B05C 17/00

[52] U.S. Cl. ..... 15/244.1; 15/104.94; 206/209; 401/11; D4/137; D32/40; D32/52

[58] Field of Search ..... 15/104.93, 104.94, 15/210.1, 244.1, 244.4; 206/209, 229, 361; 401/10, 11; D4/137; D32/35, 40, 52

[56] References Cited

U.S. PATENT DOCUMENTS

| | | | |
|---|---|---|---|
| Re. 26,385 | 5/1968 | Gilchrist | 15/210.1 |
| D. 392,079 | 3/1998 | Omerza | D32/52 |
| 2,207,959 | 7/1940 | Way et al. | 15/244.1 X |
| 2,825,084 | 3/1958 | Sanborn | 15/210.1 |
| 2,850,754 | 9/1958 | Davis | 15/244.1 X |
| 2,922,180 | 1/1960 | Render | 206/361 X |
| 2,961,677 | 11/1960 | Zecchini | 401/132 |
| 3,006,023 | 10/1961 | Worthington | 15/104.94 |
| 3,161,903 | 12/1964 | Worthington | 15/104.94 |
| 3,255,481 | 6/1966 | Adams | 15/104.94 |
| 3,386,793 | 6/1968 | Stanton | 401/132 |
| 3,466,131 | 9/1969 | Arcudi | 401/132 |
| 3,811,783 | 5/1974 | Johnson | 401/10 X |
| 3,860,348 | 1/1975 | Doyle | 401/6 |
| 3,998,559 | 12/1976 | Hoyt | 401/132 |
| 4,183,684 | 1/1980 | Avery, Jr. | 401/133 |
| 4,475,835 | 10/1984 | Verboom et al. | 401/132 |
| 4,601,081 | 7/1986 | Sutton et al. | 15/210.1 X |
| 4,779,386 | 10/1988 | Harris | 451/557 |
| 4,811,991 | 3/1989 | Moreno et al. | 301/37.1 |
| 4,953,999 | 9/1990 | Rivers | 401/10 X |
| 4,963,045 | 10/1990 | Willcox | 401/132 |
| 5,159,735 | 11/1992 | Owens et al. | 15/104.94 |
| 5,295,278 | 3/1994 | Condon | 15/104.04 |
| 5,351,356 | 10/1994 | Townsend, Jr. | 15/244.1 X |
| 5,554,417 | 9/1996 | Heming | 427/445 |

FOREIGN PATENT DOCUMENTS

| | | | |
|---|---|---|---|
| 1171623 | 1/1959 | France | 15/210.1 |
| 2 686 529 | 7/1993 | France | 15/244.1 |

*Primary Examiner*—Mark Spisich
*Attorney, Agent, or Firm*—Fulwider Patton Lee & Utecht, LLP

[57] ABSTRACT

A tire protectant applicator for spreading a liquid such as a cleaning solution or rubber conditioning agent onto the sidewall of a tire, which is constructed of porous, pliable material, configured with a concave curved surface to complementally fit the sidewall of a tire, provided at its opposite end with a handle for gripping, and further provided with a cap for storing the applicator when not in use.

21 Claims, 3 Drawing Sheets

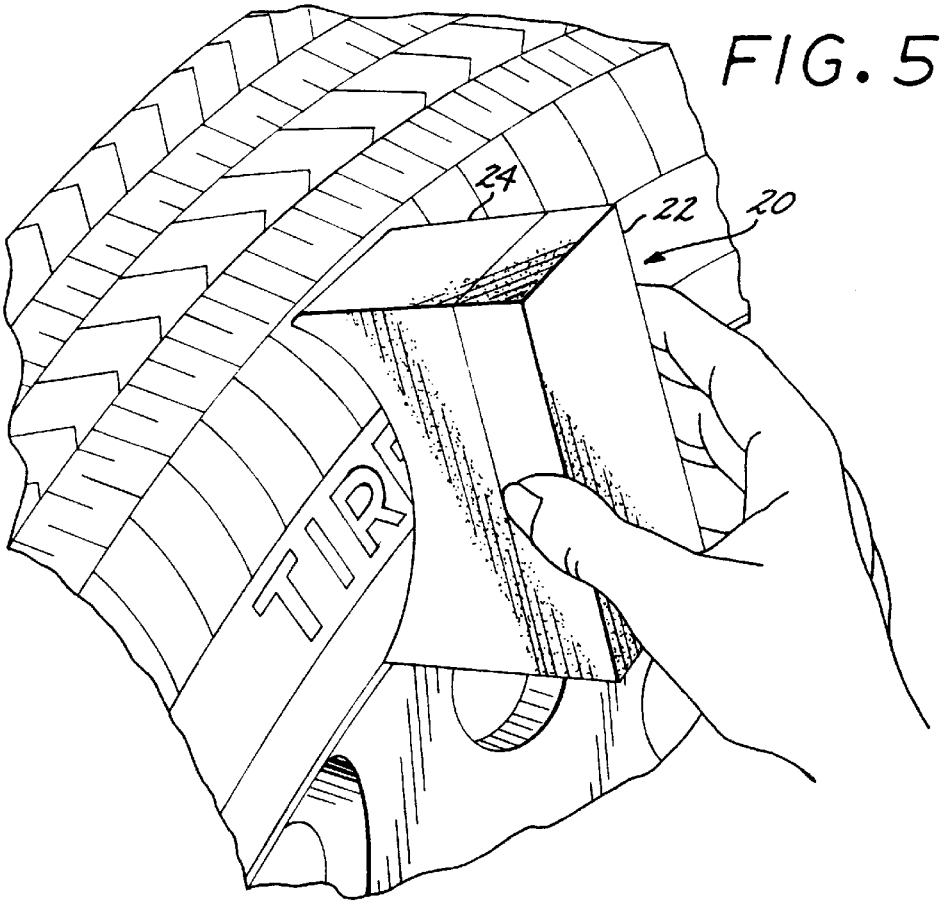
FIG. 5
FIG. 6
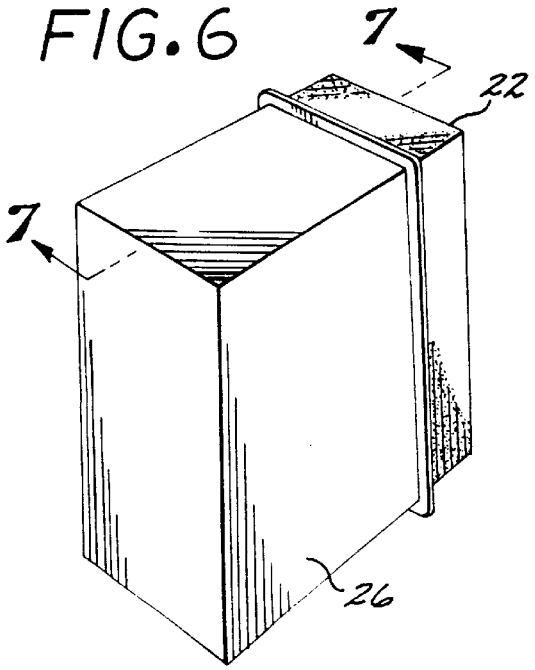
FIG. 7
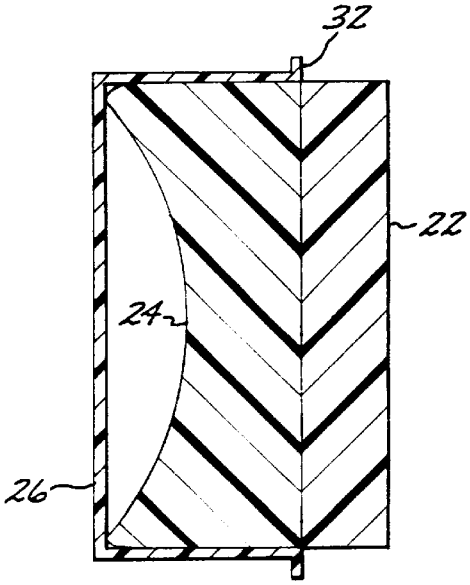

TIRE PROTECTANT APPLICATOR

This application is a divisional application of application Ser. No. 08/963,526, filed Nov. 3, 1997, now U.S. Pat. No. 5,896,616.

BACKGROUND OF THE INVENTION

1. Field of the Invention

The present invention relates to a device for conveniently applying a thin and even film of cleaning compound or rubber conditioning agent onto a tire of an automobile.

2. Description of the Prior Art

Automobile enthusiasts have long used various liquid compounds to improve the appearance of the wheels and tires of their vehicles. Cleaning compounds have been applied to remove dirt and oxidation from the rubber and condition the tire to increase the luster and aesthetic appeal of tires. These liquids are generally sprayed onto the tire from a standard spray bottle, at which point they may form an uneven pattern of small beads on the tire surface. To achieve the desired results, the user will generally spread the sprayed fluid onto the tire using a shop rag or some similar device. Use of a shop rag, however, has disadvantages. First, the used rag, being soaked with fluid, must be either be discarded or laundered after use. Laundering is time consuming, and discarding the rag requires a new rag to be used for each application which can be expensive and inconvenient. Second, a rag is not easily manipulated by the user. There is no handle for gripping, fluid on the rag can be exposed to the user's hands, requiring the user to wash his or her hands after applying the liquid. Use of a rag is, therefore, inconvenient and inefficient. Therefore, a device is needed to conveniently and efficiently spread such a fluid onto the sidewall of a tire. While many devices have been developed for spreading a liquid onto a surface, none of these devices addresses the specific needs of spreading cleaners and rubber conditioning agents onto the curved surface of a tire.

A device which has been developed to spread a liquid or semi-liquid onto a flat solid surface is disclosed in U.S. Pat. No. 4,963,045 and incorporates a solid flat bottom spreader having an upstanding handle. The substance to be spread is collected on the bottom of the spreader and sealed by a cover. When the device is to be used the handle is grasped and the cover removed. The substance is then spread onto a surface by pressing the solid flat bottom of the device onto the desired surface and moving the device latterly. While such a device is effective for applying a semi-liquid substance such as grease to a flat surface such as the bottom of a baking pan it is not effective for spreading a liquid onto the side of a tire. The solid spreader of this device will not conform to the curved surface of a tire and is not pliable enough to evenly spread a liquid over rough surfaces such as embossed lettering or the side tread of a tire.

Other devices have been developed which employ a pliable porous applicator and a handle which acts as a reservoir to hold a liquid therein. The liquid contained within the handle of these devices is absorbed into the porous applicator and the applicator applied to a solid surface thereby depositing the liquid thereon. Such devices are shown in U.S. Pat. Nos. 3,860,348; 3,998,559; 2,961,677; 3,386,793; 3,466,1331; 4,183,684; 3,006,023; 3,161,903; and 4,475,835. While these devices are effective for a variety of applications such as applying shoe polish to the surface of a shoe, they are not effective for the specific use of evenly spreading liquid onto the sidewall of a tire. The surfaces of these devices do not conform to the convex sidewall of a conventional automobile tire, and are therefore not effective in applying uniform pressure to uniformly distribute a film on the sidewall of such a tire. In addition, the relatively small surface area of these applicators make application to a tire time consuming and laborious. The devices, being disposable and having no container for storage are not conveniently reusable. These devices frequently employ handles which telescope into handle housings to compress the liquid into the applicator making the handles of these devices somewhat cumbersome to grasp. Since tire cleaning liquids and rubber conditioning agents are commonly supplied in spray bottles, there is no need for a reservoir within the handle.

Still another device has been developed for scrubbing the curved surface of a toilet seat. This device, shown in U.S. Pat. No. 5,159,735, provides a base having a concave curved surface to mate with the upper surface of a toilet seat and has an upstanding handle. Attached to the bottom of the base is an absorbent fabric. This device provides an effective and efficient means of applying a disinfectant to a toilet seat. However, the thin absorbent fabric is not sufficiently resilient to conform to the varying shapes and sizes of conventional automobile tires. Also, since the base is configured to fit the curvature of a typical toilet seat, it does not have the proper radius of curvature to complementally fit the side wall of a tire. In addition, the curved base is exposed so that any residual liquid remaining therein may contaminate a storage area such as the trunk of an automobile.

Yet another device which has been employed to clean tires, consists of an solid, abrasive block which is used to scrub the rubber of a tire. Such a device is disclosed in U.S. Pat. No. 4,779,386, and is constructed by mixing abrasive particles of stone into a binder which is then molded to form a hard abrasive block. While such a device may be effective for abrasive scrubbing, it is not suitable for spreading a fluid on a tire. The block is not shaped to complementally fit the side wall of a tire and is not pliable enough to form to the various curvatures of tire sidewalls. In addition, the hard abrasive surface of this device is not suitable to absorb and evenly distribute a fluid.

Thus there remains a need for a device which is specifically designed to spread a tire cleaning liquid or rubber conditioner onto a tire of a vehicle. A device is needed which is configured to mate with the side wall of a tire and which is sufficiently pliable to conform to the slightly varying sizes and shapes of various tires. A device is also needed which is inexpensive to manufacture and which can be conveniently stored for future uses.

SUMMARY OF THE INVENTION

Briefly, and in general terms, the present invention is of stacked construction characterized by a porous rectangular in cross section applicator having a longitudinal axis, generally perpendicular to the tangent of a curved wall of a tire to which a liquid cleaner is to be applied. The applicator is formed on its distal end with a saddle which is formed with at least a partial curve to complement the curve of the side wall. The applicator is flexible so that it can closely follow the contour of the side wall even though the curvature thereof varies around the periphery of the tire. Stacked on the proximal end of the applicator is a handle which projects proximally along the extension of such longitudinal axis and is of relatively firm construction for grasping thereof to apply a force along such axis toward the tire to firmly engage the saddle with the curvature of the tire and cause it to closely follow such curvature for positive application of the cleaning fluid.

In another possible aspect of the invention a rigid hollow handle may be provided. Such a handle can be constructed of molded thermoplastic and can be shaped for easy gripping. A rectangular pad can be included which fits within the open base of the handle to be securely affixed thereto. The porous applicator can then be affixed to the pad thereby securing the applicator to the handle. The open base of the applicator can be configured to seal against the open end of the container when the applicator is stored therein.

In still another possible aspect of the invention, a handle can be provided which is molded from a rigid foam and provided with an extended, reduced in cross section portion for having a ribbed surface for easy gripping.

In yet another aspect of the invention the applicator and handle can be formed integral from one piece of porous material. The sides of the applicator in this embodiment can be provided with scalloped finger gripping indentations to facilitate handling of the device.

Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 5 is a perspective view, showing the applicator device of FIG. 1 in contact with a tire side wall;

FIG. 6 is a perspective view showing the tire cleaner applicator device of FIG. 1 with a cap fitted thereover;

FIG. 7 is a longitudinal sectional view taken along line 7—7 of FIG. 6;

DETAILED DESCRIPTION OF THE PREFERRED EMBODIMENTS

Figure 1:
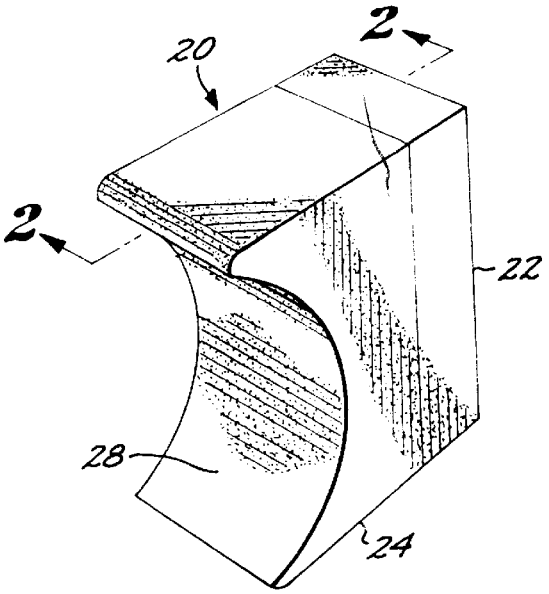
FIG. 1 is a perspective view of the applicator device embodying the present invention.

In the following detailed description, like reference numerals will be used to refer to like or corresponding elements in the different figures of the drawings. Referring to the FIGURES, the tire cleaning fluid applicator is embodied in an apparatus, generally referred to as 20 (FIGS. 6 & 7), for applying a fluid to the convex curved surface of an automobile tire. More particularly, the invention includes a handle 22 (FIG. 1), and a porous applicator 24 (FIG. 1) mounted to the end of the rigid handle.

Referring to FIG. 1 the handle 22 is generally block shaped and is dimensioned for easy gripping. The handle is preferably formed of a dense synthetic closed cell foam which can be cut from standard sheet stock such as that which is sold by Dow Chemical Company under the trade name Ethocel™.

Figure 4:
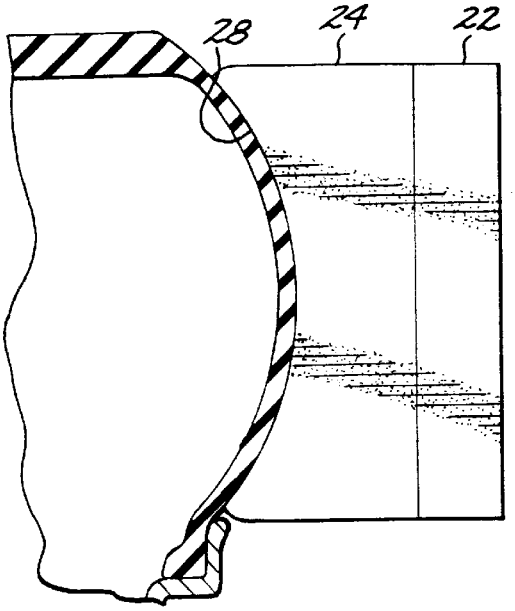
FIG. 4 is a side view of the tire applicator device shown in FIG. 1 engaged with the sidewall of a tire.

With continued reference to FIG. 1, the applicator 24 is mounted in stacked relationship at one end to the handle 22 and is configured at the distal end with a concave surface 28 to complementally fit on a convex sidewall of an automobile tire as shown in FIG. 4. The concave surface of the applicator is shaped to complement the shape of a tire sidewall to evenly spread a fluid onto a tire by applying a substantially even pressure across the length of the curved surface. The concave surface 28 preferably has a radius of 3 inches. Tires are manufactured in various shapes and sizes, and while a radius of 3 inches is ideal for complementally fitting most automobile tires, the applicator 24 is sufficiently pliable to accommodate tires which have somewhat higher or lower profiles and corresponding larger or smaller radii of sidewall curvature. Furthermore, a given tire will have a varying curvature around its circumference, being squatter and more curved at its bottom than at its top. The flexibility of the applicator 24 allows it to effectively engage the varying curvatures of a given tire sidewall.

Figure 2:
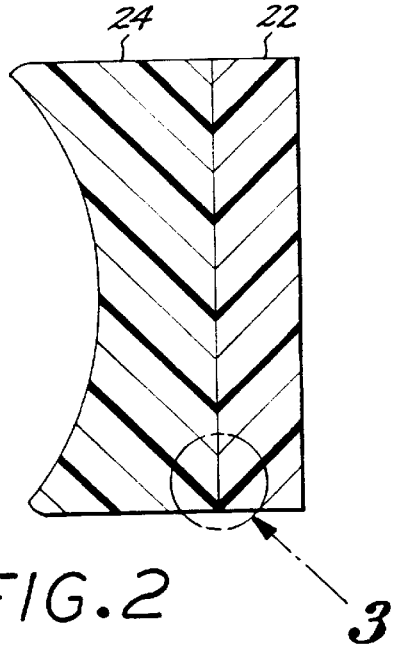
FIG. 2 is a sectional view, taken along line 2—2 of FIG. 1.
Figure 3:
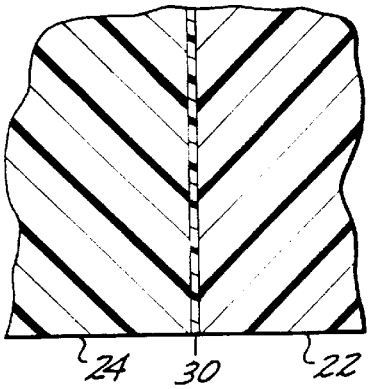
FIG. 3 is a detail view, in enlarged scale, taken from the circle designated 3 in FIG. 2.

It will be appreciated by those skilled in the art that the porous applicator 24 (FIG. 1) can be easily constructed of open cell foam, and can be either formed by injection molding or cut from a stock sheet of foam such as that which is sold by U.S. Rubber™ under the trade name Vibrin™. The porous applicator 24 is preferably affixed to the handle 22 by an adhesive 30 (FIG. 3). In the preferred embodiment, the applicator has a width of 1⅞" and a length of 5" as does the handle 22 (FIG. 1). The porous applicator 24 (FIG. 2) preferably has a depth of 2⅛ inches at either end and a depth of 1¼ inches at its center, while the handle 22 (FIG. 2) has a depth of ⅞ inches.

Referring to FIGS. 6 & 7, a cap 26 is provided, which is generally in the shape of a box having an open end 32. The hollow interior of the cap is configured with a rectangular cross section having a length of 5" and a width of 1⅞" to complementally receive the applicator 24 for storage thereof, and is of sufficient depth that when the applicator is fully inserted into the cap 26, the handle will extend out of the open end 32 of the cap.

It will be appreciated by those skilled in the art that the cap 26 (FIGS. 6 & 7) can be easily and inexpensively formed of thermoplastic and can constructed by injection molding or vacuum forming.

Refering to FIG. 5, in use, a fluid such as a cleaning fluid or rubber conditioning agent is sprayed onto the tire of the automobile. The handle 22 is then grasped, and the applicator 24 pressed onto the sidewall of the tire and moved in a circular motion, thereby evenly distributing the fluid onto the surface of the tire. When this operation is complete, the applicator 24 can be inserted into the container 26 where it can be stored until such time as is needed again. By storing the applicator within the container, the device can be conveniently stored in the vehicle without risk of soiling the interior of the vehicle with residual tire cleaning fluid which might remain on the applicator after use. Use of the container also prevents the applicator from collecting extraneous foreign matter such as dirt or lint which might otherwise stick to the residual cleaning fluid, hindering future applications of cleaning fluid or rubber conditioner.

It will be appreciated that if desired, the applicator, being constructed of open cell synthetic foam, can be easily washed using soap and water before storing the device for subsequent use with the same or another fluid.

Figure 8:
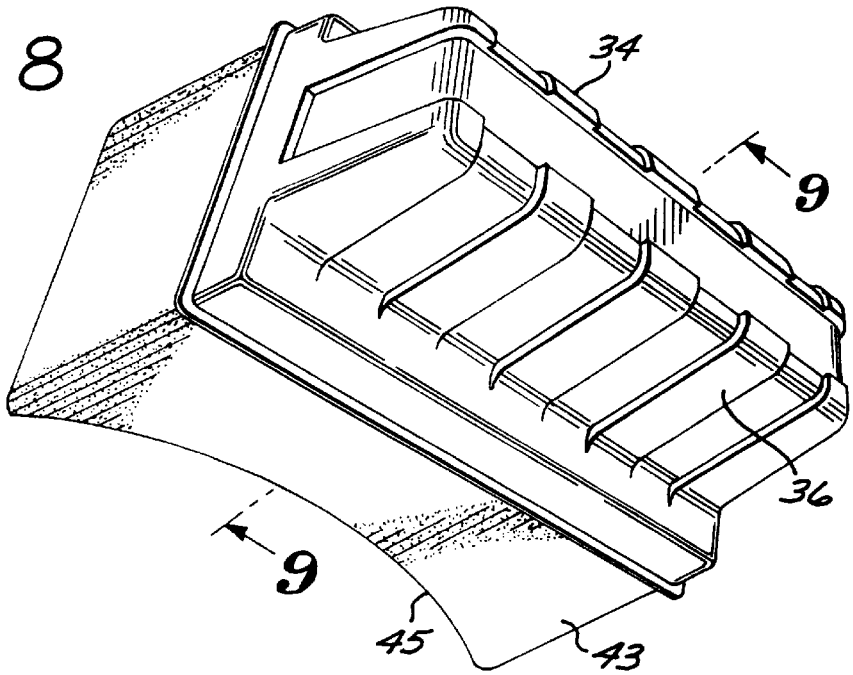
FIG. 8 is a perspective view of a second embodiment of the tire applicator device of the present invention.
Figure 9:
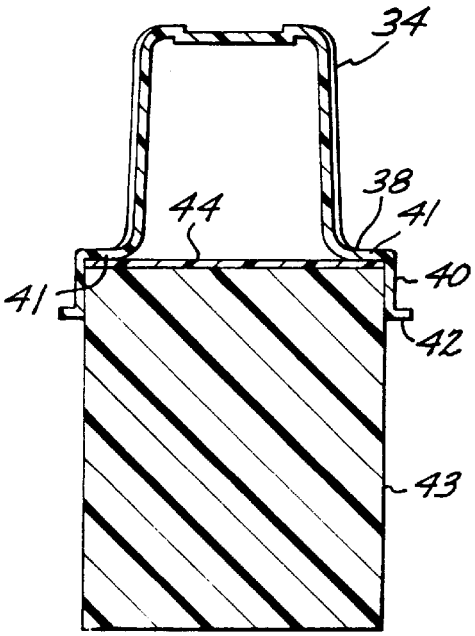
FIG. 9 is a longitudinal sectional view taken along line 9—9 of FIG. 8.

With reference to FIGS. 8, and 9, in an alternate embodiment the handle 34 is in the form of a hollow hat shaped thermoplastic hand hold element. In this embodiment the handle portion is raised to provide one end wall having a transverse groove which extends down the opposite side walls. The lateral walls are formed with ribbed outer surfaces 36 to facilitate gripping. The end of the lateral walls opposite the one end wall turn laterally outwardly to form flanking flanges 38 and then turn longitudinally to define respective opposed retainer walls 40 which cooperate with the terminus of the end walls to define a socket 41 into which the flat end of the applicator 43 nests. Such handle is formed with a perimetrical reinforcing lip 42 circumscribing the terminal edge of the applicator socket. A rectangular pad 44 overlies the flat end of the applicator to be received in the socket 41.

With reference to FIGS. 8 & 9, it will be appreciated by those skilled in the art that the handle 34 of this embodiment can be easily formed by either injection molding or vacuum forming. The pad 44 can be cut from a sheet of rigid plastic and affixed to the lip 38 and vertical wall 40 by an adhesive. Likewise, the applicator 43 can be affixed to the pad 44 by an adhesive.

The device of this embodiment is used in the same way as the previously described embodiment. A tire cleaning fluid or rubber conditioning agent is applied to a tire using a spray bottle. The applicator is then grasped at the handle, and the curved surface 45 of the applicator (FIG. 8) pressed against the convex curved sidewall of the tire. The applicator is then moved in a curved motion to evenly distribute the fluid onto the tire. After use the applicator can be inserted into the cap 26 (FIGS. 6 & 7) so that the reinforcing lip 42 fits against the open end 32 (FIG. 7) of the cap. In this way the applicator can be conveniently stored until future use. The hand molded handle of this embodiment serves to important functions. First, the reduced-in-cross section shape and ribbed surface makes the handle easier to grasp. Second, the stiffness of the hard plastic handle provides added stability for gripping and manipulating the device.

Figure 10:
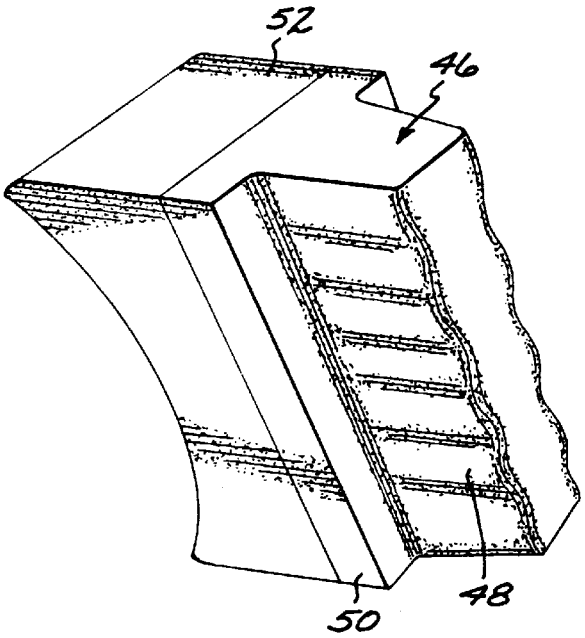
FIG. 10 is a perspective view of a third embodiment of the tire applicator device of the present invention.

Referring to FIG. 10, in another embodiment of the invention, a contoured handle 46, is provided to facilitate easy manipulation of the device. The handle of this embodiment is not hollow, and is formed with an extended, reduced in cross section portion having a ribbed surface 48 for ease of gripping. The bottom of the handle 46 extends outwardly in a transverse direction to form a rectangular base 50 from which to mount the applicator 52. It will be appreciated by those skilled in the art that the handle of this embodiment can be easily constructed rigid closed cell foam formed by injection molding but can also be formed of other materials. The handle 46 of this embodiment can be affixed to the applicator 52 by an adhesive. This embodiment provides improved handling characteristics at nominal extra cost by providing a molded foam handle which can be easily grasped and manipulated.

In yet another embodiment, not shown, the end of the applicator, is extended opposite the curved surface to form an integral handle. The two longer sides of the applicator are scalloped to provide finger gripping surfaces near the end opposite the curved surface. In this embodiment the applicator and handle are formed of one piece of pliable open cell foam. The applicator of this embodiment, as in the previously discussed embodiments, is configured to fit within the cap, but the applicator is of sufficient depth that the finger gripping surfaces extend outside of the container when the applicator is fully inserted therein, allowing the applicator to be easily gripped and removed from the container for subsequent use.

The applicator of this embodiment can be formed by injection molding, and will be used in the same way as the previously described embodiments by applying fluid to the tire using a spray bottle and then spreading the fluid by applying the applicator to the tire with a circular motion.

From the forgoing it will be appreciated that the present invention provides an inexpensive device for efficiently and conveniently applying an evenly distributed film of cleaning fluid or rubber conditioning agent to the convex curved surface of a tire sidewall. Convenience and efficiency are further enhanced by the provision of a container for storing the applicator after use. While several forms of the invention have been illustrated and described, it will also be apparent that various modifications can be made without departing from the spirit and scope of the invention.

What is claimed is:

1. A tire cleaning fluid applicator device for cleaning the convex curved sidewall surface of a tire comprising:

a block shaped handle having a central longitudinal handle axis and terminating on a distal side to form an applicator base; and a block shaped porous applicator, having a central longitudinal applicator axis aligned with said longitudinal handle axis and terminating in proximal and distal ends, centrally mounted at said proximal end to said applicator base, elongated laterally with respect to said applicator longitudinal axis, and formed on said distal end of said applicator with at least a portion of a concave porous saddle to contact at least a portion of said curved sidewall to conform to the shape thereof.

2. A tire cleaning fluid applicator device as set forth in claim 1, wherein:

said applicator is constructed of synthetic open cell foam.

3. A tire cleaning fluid applicator device as set forth in claim 1, wherein:

said handle is constructed of dense foam and said applicator of lightweight foam.

4. A tire cleaning fluid applicator device as set forth in claim 1, wherein:

said handle is rectangular in transverse cross section.

5. A tire cleaning fluid applicator device as set forth in claim 1, wherein:

said handle is constructed of styrene.

6. A tire cleaning fluid applicator device as set forth in claim 1, wherein:

said block shaped porous applicator has a width in the lateral direction perpendicular to said axis of 4–6 inches.

7. A tire cleaning fluid applicator device as set forth in claim 1, wherein:

said applicator has a first lateral dimension of 4–6 inches and a second lateral dimension perpendicular thereto of 1½–2½ inches.

8. A tire cleaning fluid applicator device as set forth in claim 1, wherein:

said block shaped porous applicator has a first lateral dimension of 5 inches, with respect to said axis, a second lateral dimension of 1⅞ inches, perpendicular to said first lateral dimension, and a longitudinal dimension of 2⅛ inches; and said handle has a longitudinal dimension of ⅞ inches, a first lateral dimension of 5 inches with respect to said axis, and a second lateral dimension of 1⅞ inches perpendicular to said first lateral dimension.

9. A tire cleaning fluid applicator device as set forth in claim 1, wherein:

said applicator is formed with a transverse cross section projecting laterally at least five inches relative to said longitudinal axis.

10. A tire cleaning fluid applicator device as set forth in claim 1, wherein:

said handle is formed of thermoplastic.

11. A tire cleaning fluid applicator device as set forth in claim 1, wherein:

said handle is die cast.

12. An applicator apparatus as set forth in claim 1, wherein:

said applicator is rectangular in transverse cross section from one longitudinal end to the other.

13. An applicator apparatus as set forth in claim 1, wherein:

said handle is constructed of closed cell synthetic foam.

14. An applicator apparatus as set forth in claim 1, wherein:

said handle and applicator are affixed to one another by an adhesive.

15. A applicator apparatus as set forth in claim 1, wherein:

said block shaped applicator has a transverse cross section measuring 4–6 inches×1½–2½ inches.

16. A tire cleaning fluid applicator device as set forth in claim 1 wherein:

said handle is rectangular in transverse cross section and has a depth in the axial direction of substantially ⅞ inch throughout.

17. A tire cleaning fluid applicator device as set forth in claim 1 wherein:

said handle is constructed of dense closed cell foam.

18. A tire cleaning fluid applicator device as set forth in claim 1 wherein:

said handle and said porous applicator are formed with peripheral walls aligned with one another.

19. A tire cleaning fluid applicator device as set forth in claim 16 wherein:

said handle is constructed of dense closed cell foam.

20. A tire cleaning fluid applicator device as set forth in claim 16 wherein:

said handle is formed with the peripheral walls cooperating to form a predetermined rectangular cross-section and said porous applicator is formed with said proximal end configured with said predetermined cross-section.

21. A tire cleaning fluid applicator for applying liquid cleaner to the convex, curved surface of a tire sidewall, comprising:

a porous flexible applicator formed centrally with a longitudinal axis to, when in use, project perpendicular to the tangent to said curved sidewall and formed on one axial end with a curved applicator surface opening in one direction and shaped to complement at least a portion of said tire sidewall to apply said cleaner thereto and formed on the axially opposite end with a handle surface; and a substantially rigid handle mounted in stacked relationship on said handle surface and configured with a hand press surface facing in the direction opposite said one direction, said handle projecting along said longitudinal axis whereby said cleaner may be applied to said applicator and said handle grasped by a user's hand to press against said hand press surface to move said applicator axially toward said curved wall to contact said sidewall and be pressed thereagainst to flex said applicator to conform to irregularities in the curvature of said curved wall.

* * * * *